US011204046B2

(12) United States Patent
Dittrich et al.

(10) Patent No.: US 11,204,046 B2
(45) Date of Patent: Dec. 21, 2021

(54) FUEL-OPERATED FIRING DEVICE AND METHOD FOR OPERATING A FIRING DEVICE OF THIS TYPE

(71) Applicant: Hilti Aktiengesellschaft, Schaan (LI)

(72) Inventors: Tilo Dittrich, Feldkirch (AT); Daniel Jung, Munich (DE); Dominik Schmidt, Buchs (CH); Peter Bruggmueller, Bludesch (AT); Philipp Heinze, Munich (DE); Norbert Heeb, Buchs (CH); Edwin Staudacker, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 571 days.

(21) Appl. No.: 16/063,782

(22) PCT Filed: Dec. 20, 2016

(86) PCT No.: PCT/EP2016/081897
§ 371 (c)(1),
(2) Date: Jun. 19, 2018

(87) PCT Pub. No.: WO2017/108772
PCT Pub. Date: Jun. 29, 2017

(65) Prior Publication Data

US 2020/0271141 A1 Aug. 27, 2020

(30) Foreign Application Priority Data

Dec. 22, 2015 (EP) ..... 15201895

(51) Int. Cl.
*F15B 15/19* (2006.01)
*B25C 1/08* (2006.01)

(52) U.S. Cl.
CPC ..... *F15B 15/19* (2013.01); *B25C 1/08* (2013.01); *F15B 2215/30* (2013.01)

(58) Field of Classification Search
CPC ..... B25C 1/08; F15B 2215/30; F15B 15/19
(Continued)

(56) References Cited

U.S. PATENT DOCUMENTS 4,483,473 A * 11/1984 Wagdy ..... F02P 11/04 123/46 SC
4,913,331 A * 4/1990 Utsumi ..... B25C 1/08 227/10

(Continued)

FOREIGN PATENT DOCUMENTS

CN 1042217 A 5/1990
CN 1134681 A 10/1996

(Continued)

OTHER PUBLICATIONS

International Bureau, International Search Report in International Application No. PCT/EP2016/081897, dated Apr. 13, 2017.

*Primary Examiner* — Thanh K Truong
*Assistant Examiner* — Xavier A Madison
(74) *Attorney, Agent, or Firm* — Leydig, Voit & Mayer, Ltd.

(57) ABSTRACT

The invention relates to a fuel-operated firing device for driving securing elements into a substrate, comprising at least one main combustion chamber for a fuel, a driving piston that can be driven out of the main combustion chamber in a firing direction by expandable gases, and a pre-chamber with which an ignition device is associated and in which a pressure acting on the main combustion chamber can build up prior to a fuel-air mixture being ignited in said main combustion chamber. In order to improve the efficacy and/or functionality during the driving in of securing elements using the fuel-operated firing device, the pre-chamber has at least two venting connections which are mutually spaced in an axial direction and which have passages that (Continued)

can be exposed conjointly in order to facilitate rapid venting of the pre-chamber.

20 Claims, 9 Drawing Sheets

(58) Field of Classification Search
USPC ..... 227/10
See application file for complete search history.

(56) References Cited

U.S. PATENT DOCUMENTS

| | | | | |
|---|---|---|---|---|
| 5,000,128 | A | 3/1991 | Veldman | |
| 5,497,929 | A | 3/1996 | Armstrong | |
| 5,909,836 | A | 6/1999 | Shkolnikov et al. | |
| 6,755,159 | B1 | 6/2004 | Adams et al. | |
| 7,427,007 | B2 | 9/2008 | Shima et al. | |
| 7,703,648 | B2 * | 4/2010 | Tamura | B25C 1/08 227/8 |
| 2004/0079302 | A1 | 4/2004 | Wolf et al. | |
| 2004/0144357 | A1 | 7/2004 | Adams | |
| 2005/0001000 | A1 | 1/2005 | Favre-Bulle et al. | |
| 2005/0173486 | A1 | 8/2005 | Moeller et al. | |
| 2009/0250499 | A1 | 10/2009 | Hahn et al. | |
| 2010/0065602 | A1 | 3/2010 | Zhao et al. | |
| 2015/0343625 | A1 * | 12/2015 | Ricordi | B25C 1/08 29/432 |
| 2016/0144497 | A1 | 5/2016 | Boehm et al. | |

FOREIGN PATENT DOCUMENTS

| | | | |
|---|---|---|---|
| CN | 1217967 | A | 6/1999 |
| CN | 1494989 | A | 5/2004 |
| DE | 40 10 517 | A1 | 10/1991 |
| DE | 42 43 617 | A1 | 6/1994 |
| DE | 102 32 035 | A1 | 1/2004 |
| DE | 103 27 191 | B3 | 12/2004 |
| EP | 2 106 883 | A1 | 10/2009 |
| EP | 2 826 601 | A1 | 1/2015 |
| JP | 2007-521974 | A | 8/2007 |
| WO | WO 2017/108782 | A1 | 6/2017 |
| WO | WO 2017/108787 | A1 | 6/2017 |

* cited by examiner

FUEL-OPERATED FIRING DEVICE AND METHOD FOR OPERATING A FIRING DEVICE OF THIS TYPE

CROSS-REFERENCE TO RELATED APPLICATIONS

This patent application is the U.S. National Stage of International Patent Application No. PCT/EP2016/081897, filed Dec. 20, 2016, which claims the benefit of European Patent Application No. 15201895.8, filed Dec. 22, 2015, which are each incorporated by reference.

TECHNICAL FIELD

The invention relates to a fuel-operated firing device for driving securing elements into a substrate, comprising at least one main combustion chamber for a fuel, a driving piston which can be driven out of the main combustion chamber in a firing direction by means of expandable gases, and a pre-chamber with which an ignition device is associated and in which a pressure acting on the main combustion chamber can build up prior to a fuel/air mixture being ignited in said main combustion chamber. Furthermore, the invention relates to a method for operating such a firing device.

BACKGROUND OF THE INVENTION

German unexamined patent application DE 10 32 035 A1 discloses a fuel-operated firing device for driving securing elements into a substrate, comprising at least one main combustion chamber for a fuel, a driving piston which is mounted in a piston guide and can be driven out of the main combustion chamber in the firing direction by means of expanding gases, and a pre-chamber with which an ignition device is associated and in which a pressure acting on the main combustion chamber can build up prior to a fuel/air mixture being ignited in said main combustion chamber, wherein the pre-chamber is formed by a space inside the piston guide which adjoins the underside, remote from the main combustion chamber, of the driving piston located in its starting position, and wherein the pre-chamber is connected to the main combustion chamber at least intermittently via a passage, wherein in the main combustion chamber a means for detection of the pressure is provided, which interacts with the ignition device for the main combustion chamber. German unexamined patent application DE 42 43 36 17 A1 discloses a handheld, fuel-operated working device, in particular a firing device for securing elements, having a cylindrical combustion chamber for combustion of an air/fuel mixture, so that a ram can be driven by means of a piston guided through the combustion chamber, wherein a pre-chamber is provided which communicates with an underneath surface of the piston facing away from the combustion chamber and in which an ignition-induced combustion process of an air/fuel mixture can be initiated for the substantially isentropic compression of the air/fuel mixture in the combustion chamber.

BRIEF SUMMARY OF THE INVENTION

The object of the invention is to improve the effectiveness and/or functionality during the driving in of securing elements using a fuel-operated firing device, at least one main combustion chamber for a fuel, a driving piston which can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber.

In a fuel-operated firing device for driving securing elements into a substrate, comprising at least one main combustion chamber for a fuel, a driving piston which can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber, this object is achieved in that the pre-chamber has at least two venting connections spaced apart from one another in an axial direction and having through openings which can in particular be closed and exposed in order to enable rapid venting of the pre-chamber. The term "axial" relates to a longitudinal axis or movement axis of the driving piston. The driving piston is preferably substantially rotationally symmetrical. In operation of the fuel-operated firing device the driving piston is guided movably back and forth in the direction of its longitudinal axis. "Axial" means in the direction of or parallel to the movement axis of the driving piston. The through openings of the venting connections preferably extend in radial directions, that is to say transversely with respect to the longitudinal axis of the driving piston.

A preferred exemplary embodiment of the fuel-operated firing device is characterized in that a first venting connection in the axial direction is spaced further apart from the main combustion chamber than a second venting connection. The main combustion chamber is preferably arranged coaxially with respect to the pre-chamber. An end of the pre-chamber remote from the main combustion chamber is also designated as a firing end. An extremely rapid movement of the driving piston in operation of the firing device is also designated as a piston flight. The first venting connection advantageously serves to provide a large venting cross section if the pre-chamber is to be scavenged by a piston flight. During operation of the firing device, by means of both venting connections the old gas can be displaced over the piston flight path. The second venting connection advantageously serves during a first piston flight phase to discharge the residual gases located in the pre-chamber. The effective cross section for the ventilation of the pre-chamber can be significantly increased by the two venting connections. In a second piston flight phase, if a piston head or piston plate has travelled over the second venting connection, the combustion gases from the main combustion chamber can be discharged over the venting cross section of the second venting connection. As a result, a thermal piston return is enabled in a simple manner by formation of negative pressure in the main combustion chamber.

A further preferred exemplary embodiment of the fuel-operated firing device is characterized in that the first venting connection is arranged in the vicinity of a stop and/or damping element for the driving piston. The stop and/or damping element or a plurality of stop and/or damping elements constitute a buffer device for the driving piston. The buffer device is advantageously arranged on an end of the pre-chamber, which end faces away from the main combustion chamber and corresponds to the firing end.

A further preferred exemplary embodiment of the fuel-operated firing device is characterized in that the venting connections in each case comprise a series of through openings in a pre-chamber cylinder. The through openings are spaced uniformly apart from one another in the pre-chamber cylinder, preferably in a circumferential direction. A large effective venting cross section can be provided in a simple manner by a corresponding number and size of the passage openings in the pre-chamber cylinder.

A further preferred exemplary embodiment of the fuel-operated firing device is characterized in that the venting connections comprise through openings in a control sleeve which, in an open position of the control sleeve, are made to overlap the through openings of the pre-chamber cylinder in order to expose the venting connections, in particular jointly. The control sleeve is preferably configured and movable relative to the through openings of the pre-chamber so that the through openings of the pre-chamber are exposed or closed by the control sleeve depending upon a main combustion chamber pressure. The control sleeve has, for example, substantially the configuration of a straight circular cylindrical shell, which is movable relative to the pre-chamber cylinder, which delimits the pre-chamber, between the open position, in which the through openings of the pre-chamber are exposed or opened, and a closed position, in which the through openings the pre-chamber are closed.

A further preferred exemplary embodiment of the fuel-operated firing device is characterized in that the control sleeve is combined with a non-return valve device for the venting connections which opens in the event of a positive pressure in the pre-chamber if the control sleeve is in the open position. In the event of a positive pressure in the pre-chamber, the non-return valve device enables the venting connections to be opened towards the surroundings. As a result the positive pressure in the pre-chamber can be reduced in a simple manner if the control sleeve is in its open position. The non-return valve device comprises, for example, closure elements which are designed as non-return lamellas. The non-return lamellas expose the venting connections only above a certain positive pressure in the pre-chamber and close the venting connections again as soon as the positive pressure in the pre-chamber is reduced. As a result an undesirable flowing back of exhaust gases from an exhaust gas system into the pre-chamber of the bolt firing device is prevented. According to a further aspect of the invention the non-return valve device, in particular the non-return lamellas, can also be installed independently of the control sleeve in a further configuration of the exhaust gas system. As a result it is possible to reduce undesirable dynamic influences arising out of movements of the control sleeve due to the firing process.

A further preferred exemplary embodiment of the fuel-operated firing device is characterized in that the non-return valve device comprises closing elements made of a spring steel material. The closing elements made of the spring steel material comprise, for example, valve elements which are in each case associated with two through openings of different venting connections. The valve elements are connected to one another, for example, by a connecting ring member. The connecting ring member can likewise be formed of spring steel material.

A further preferred exemplary embodiment of the fuel-operated firing device is characterized in that a pre-chamber inlet is provided at an end of the pre-chamber cylinder remote from the main combustion chamber. The two venting connections are closed by the control sleeve during pre-combustion. During a main combustion the two venting connections are exposed by the control sleeve, that is to say for the discharge of exhaust gases in front of the piston in the pre-chamber. In order that the exhaust gases just discharged are not drawn in again, the control sleeve is combined with the previously described non-return valve device. Fresh air is then drawn in as required through the additional pre-chamber cylinder inlet on the end of the pre-combustion chamber remote from the main combustion chamber. The fresh air is then advantageously drawn in through the pre-chamber inlet into the pre-chamber if a negative pressure in the cooling main combustion chamber retracts the driving piston.

Furthermore, the invention relates to a method for operating a previously described fuel-operated firing device. The pre-chamber can advantageously be opened by means of the two venting connections quickly enough so that the driving piston does not run in an undesirable manner onto an exhaust gas cushion runs and thus lose power. In a firing operation all of the pre-chamber exhaust gases can be discharged rapidly and effectively into the environment by means of the two venting connections. The venting by means of the two venting connections is also designated as double pre-chamber venting. The double pre-chamber venting enables a very rapid counter-pressure reduction in the pre-chamber and ultimately leads to a higher device energy, since the driving piston does not run onto an exhaust gas cushion or into an exhaust gas cushion. The non-return valve device, which is combined with the control sleeve and can also be arranged in the further course of the exhaust gas system, prevents an undesirable intake of old gas in a simple manner during the thermal return of the driving piston. The non-return valve device ensures in a simple manner that only fresh air is drawn in via the pre-chamber intake, which can also be designated as a pre-chamber inlet. Furthermore, the non-return valve device advantageously prevents dirt from collecting in the region of the venting connections and prevents damage to any seals which may be provided in the region of the venting connection.

Furthermore, the invention relates to a control device, a control sleeve, a pre-chamber cylinder and/or a non-return valve device for a previously described firing device. Said parts can be handled separately.

BRIEF DESCRIPTION OF THE SEVERAL VIEWS OF THE DRAWING(S)

Further advantages, features and details of the invention are apparent from the following description in which various embodiments of the invention are described in detail with reference to the drawings. In the drawings.

DETAILED DESCRIPTION OF THE INVENTION

Figure 1:
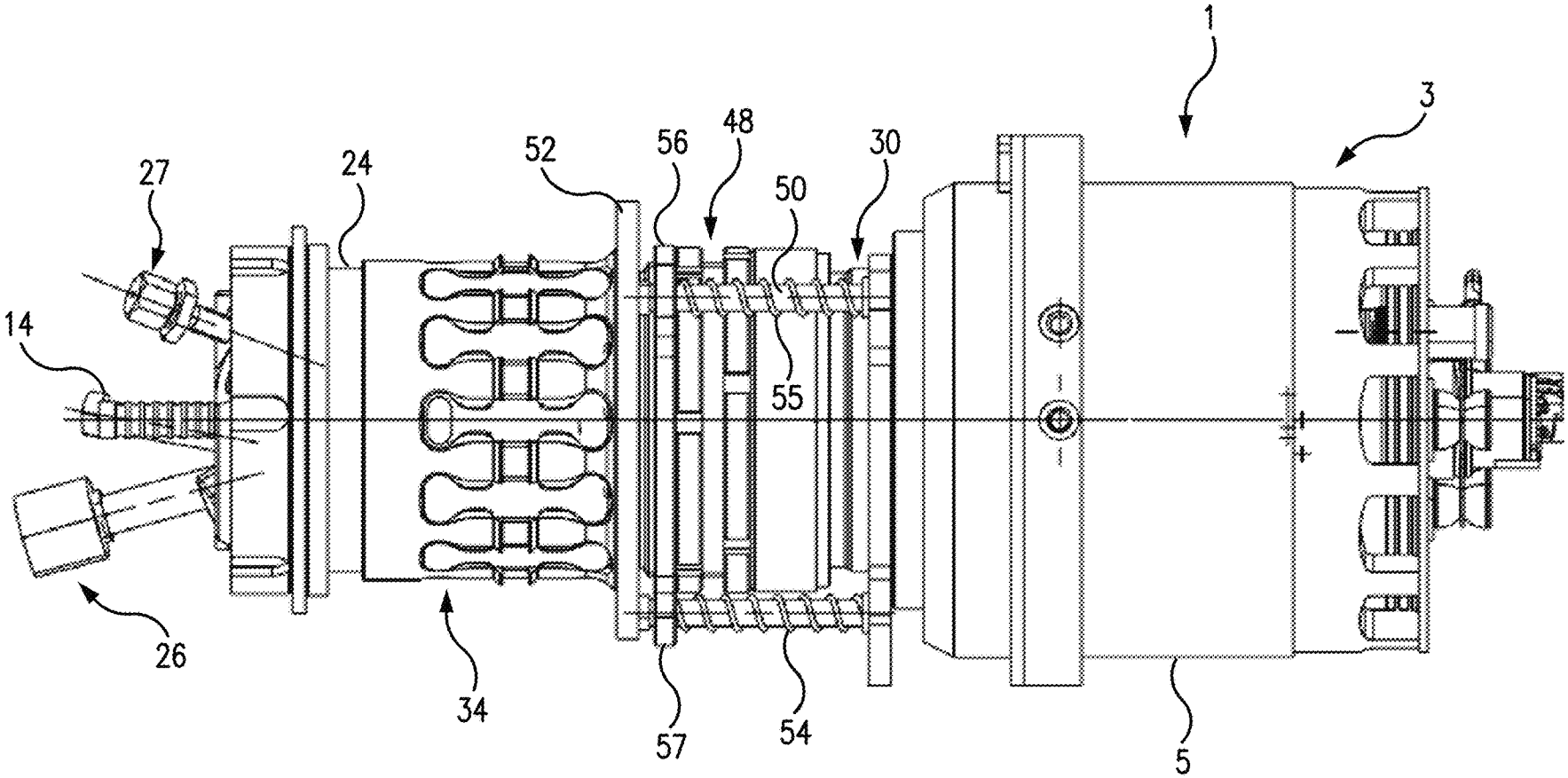
FIG. 1 shows a plan view of a fuel-operated bolt firing device in an unpressed initial state during scavenging of a main combustion chamber.

FIGS. 1 to 7 show a highly simplified longitudinal section of a firing device 1 in different operating states and views. The firing device 1 shown in FIGS. 1 to 7 can be operated with a fuel gas or with a vaporizable liquid fuel. The firing device 1 comprises a housing 3 with a main cylinder 5 which delimits a main combustion chamber 6. The main combustion chamber 6 can be supplied with gas and/or air by means of an inlet device 8. Furthermore, an ignition device 9 is associated with the main combustion chamber 6.

Figure 6:
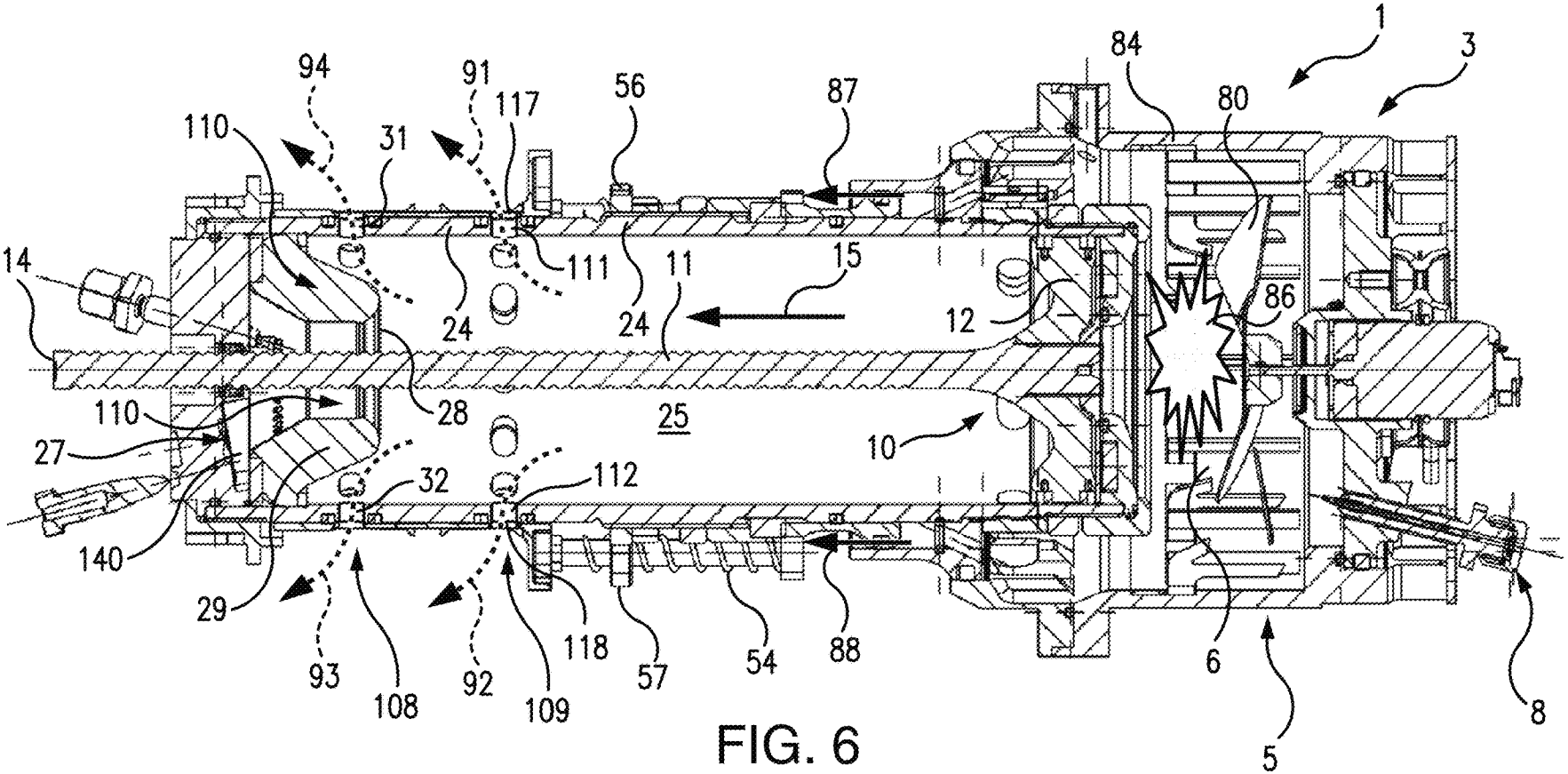
FIG. 6 shows a longitudinal section of the bolt firing device from FIGS. 1 to 5 during ignition in the main combustion chamber with opened venting connections.
Figure 7:
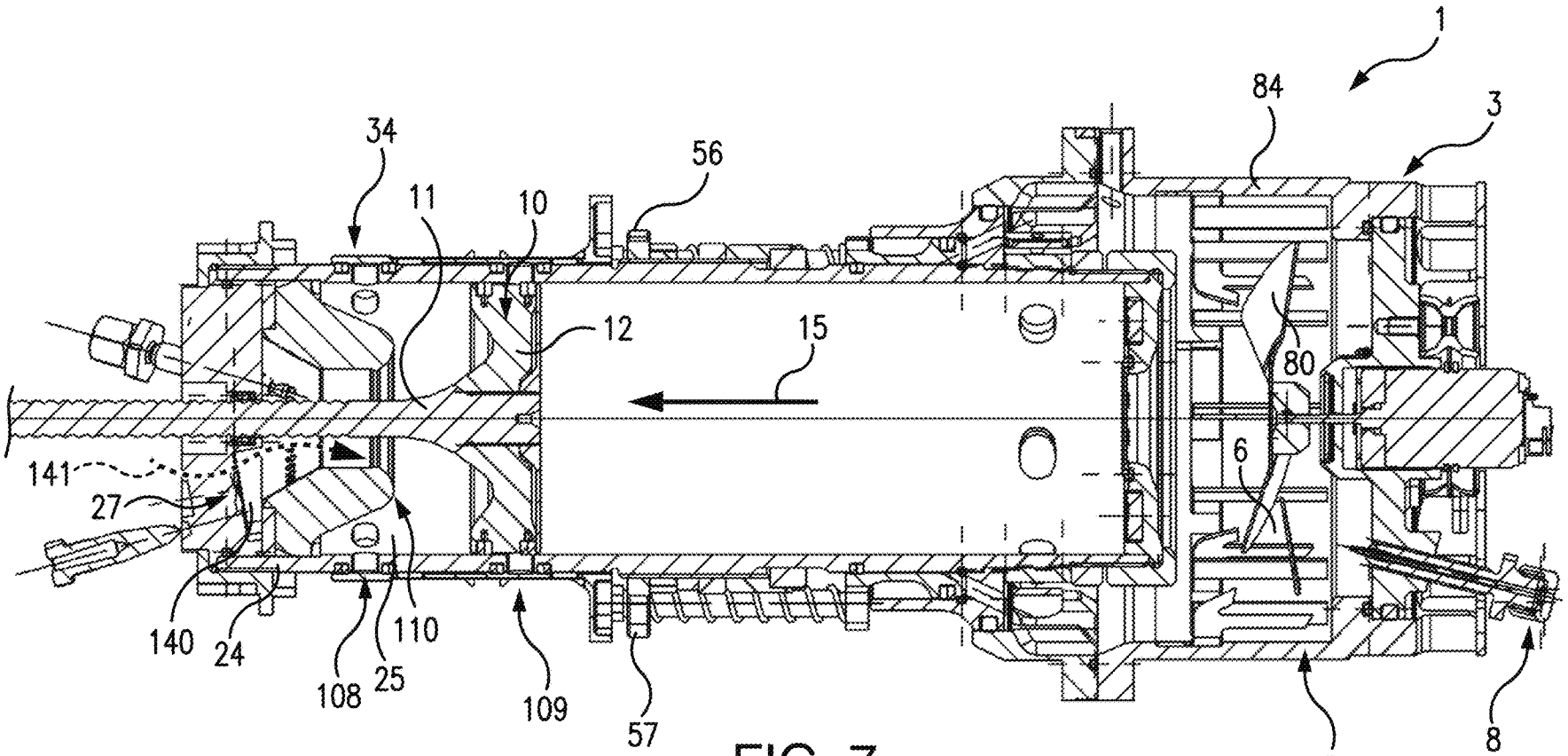
FIG. 7 shows a longitudinal section of the bolt firing device from FIGS. 1 to 6 during thermal return of a driving piston with closed venting connections.
Figure 9:
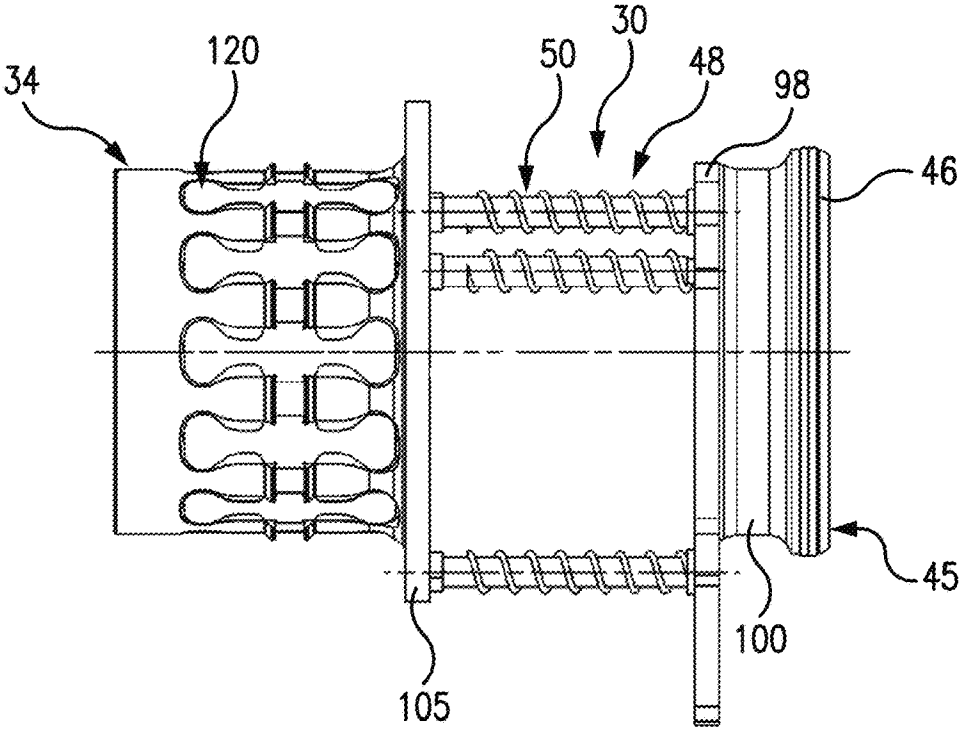
FIG. 9 shows a plan view of the control device from FIG. 8.
Figure 8:
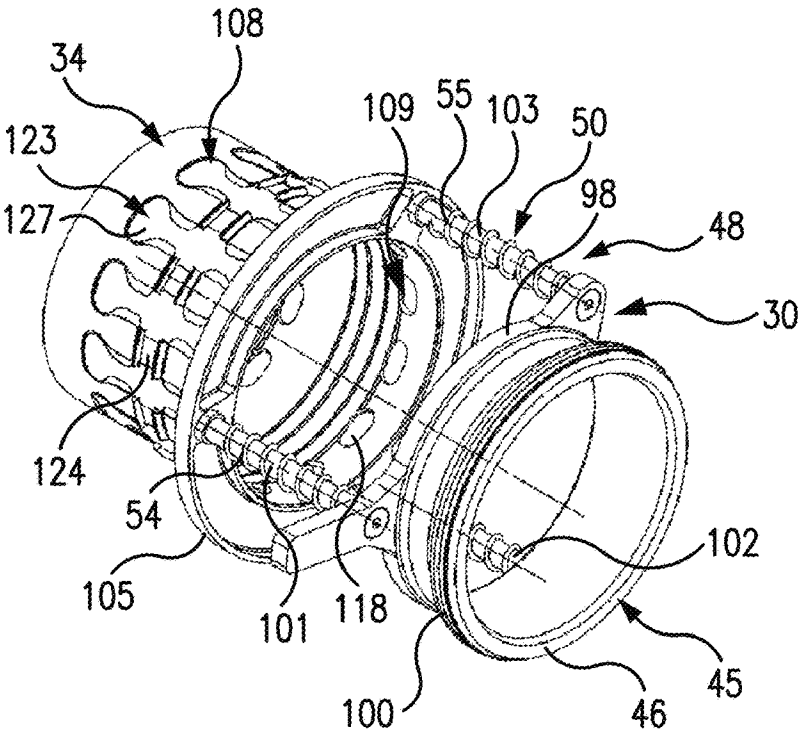
FIG. 8 shows a perspective representation of a control device from FIGS. 1 to 6.

In FIGS. 1 to 7 a driving piston 10 is guided movably back and forth in the housing 3 of the firing device 1. The driving piston 10 comprises a piston rod 11 which extends from a piston head 12. A firing end 14 of the piston rod 11 remote from the piston head or piston plate 12 is arranged in a bolt guide which serves for operating securing elements which are also designated as bolts. In FIG. 7 is the firing end 14 of the piston rod 11 of the driving piston 10 is shown truncated.

The bolt guide with the piston rod 11 of the driving piston 10 arranged therein is also designated as a firing unit. By means of the firing unit a securing element, such as a nail, bolt or the like, can be driven into a substrate (not shown). Before the firing of a securing element, the firing device 1 with its bolt guide is pressed onto the substrate and triggered. A switch (not shown) which is also designated as a trigger switch serves, for example, for triggering a firing operation. The switch is provided, for example, on a handle (likewise not shown) of the firing device 1.

A firing device is indicated by an arrow 15 in FIGS. 1 to 7. During the firing of a securing element, the driving piston 10 with the piston rod 11 is greatly accelerated in the firing direction 15 in order to drive the securing element into the substrate. During the firing operation, the driving piston 10 is moved out of its starting position shown in FIG. 1, which corresponds to an upper or rear dead center, into an end position which corresponds to a lower or front dead center.

A movement of the driving piston 10 towards the right in FIGS. 1 to 7 is delimited by a piston stop 16 fixed to the housing. The upper dead center of the driving piston 10 is defined by the piston stop 16. The piston stop 16 can be combined with a magnet device 17. The magnet device 17 serves, for example, to hold the driving piston 10 with a predetermined holding force in its starting position shown in FIG. 1.

A movement of the driving piston 10 towards the left is delimited by stop and/or damping elements 28, 29. The stop and/or damping elements 28 constitute a buffer 110. The piston head 12 comprises a first piston surface 21 which faces the main combustion chamber 6. A second piston surface 22, which faces away from the main combustion chamber 6, delimits a pre-chamber 25 in a pre-chamber cylinder 24.

The pre-chamber 25 constitutes a pre-combustion chamber with which an ignition device 26 and an inlet device 27 are associated. Furthermore, the stop and/or damping elements 28, 29 are arranged in the pre-chamber 25. A gas/air fuel mixture, which is ignited with the aid of the ignition device 26 in the pre-chamber 25, is supplied to the pre-chamber or pre-combustion chamber 25 by means of the inlet device 27.

The pre-chamber cylinder 24 comprises through openings 31, 32 which, for example, enable the exhaust gases to exit the pre-chamber 25. The through openings 31, 32 can be closed as required by a control device 30. The control device 30 comprises a control sleeve 34 which has through openings 37, 38.

Figure 11:
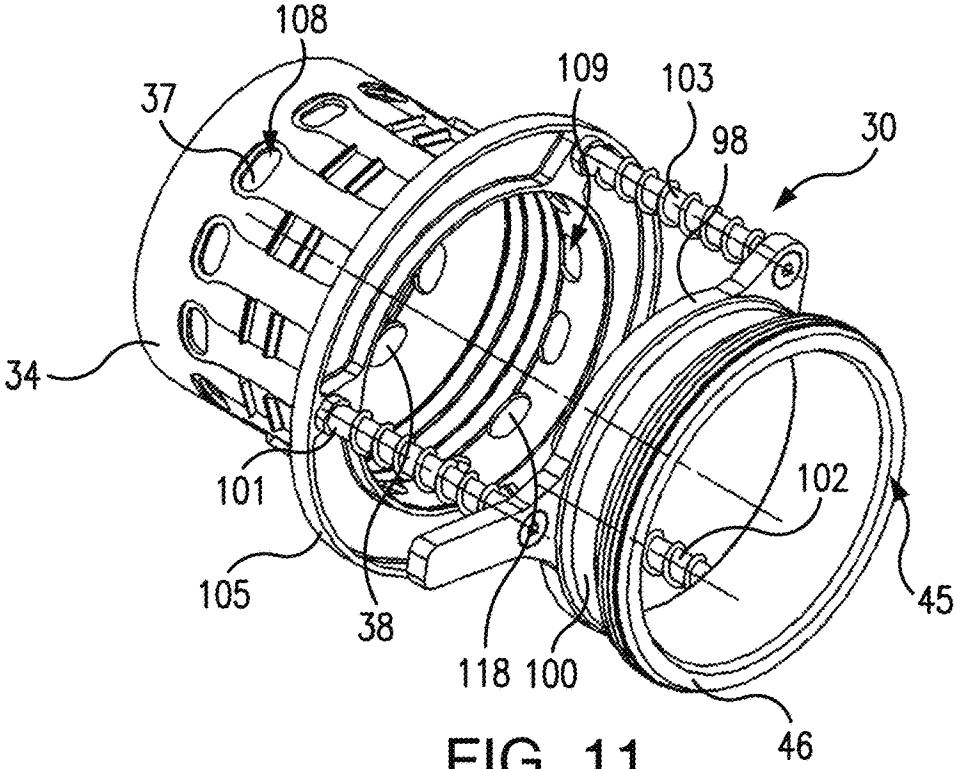
FIG. 11 shows a perspective representation of the control device from FIGS. 8 and 9 without the non-return valve device which is shown alone in FIG. 10.

If the through openings 37, 38 of the control sleeve 34 are made to overlap the through opening 31, 32, then the through openings 31, 32 are opened, as can be seen in FIG. 6. In FIGS. 1 to 5 and 7 the through openings 31, 32 are closed by the control sleeve 34. The control sleeve 34 has substantially the configuration of a straight circular cylindrical shell and is illustrated in detail in FIG. 11.

Overflow openings 41, 42 are provided between the pre-chamber 25 and the main combustion chamber 6. A valve device 43, 44 is associated with each of the overflow openings 41, 42. The valve devices 43, 44 are, for example, valve flaps which enable a passage of an ignited air/fuel mixture from the pre-chamber 25 into the main combustion chamber 6.

The control device 30 comprises a control pressure surface 45, which is connected to the main combustion chamber 6 for control pressure purposes. The control pressure surface 45 is designed as an annular surface 46 which faces the main combustion chamber 6 radially outside the pre-chamber cylinder 24. The control pressure surface 45 is coupled mechanically to the control sleeve 34 by means of a coupling element 48.

The coupling element 48 is designed as a slider 50 which, in FIGS. 1 to 7, is guided movably back and forth in the horizontal direction on the pre-chamber cylinder 24. The control pressure surface 45 designed as an annular surface 46 is provided on a right-hand end 51 of the slider 50 in FIGS. 1 to 7. The control control sleeve 34 is fastened to a left-hand end 52 of the slider 50 in FIGS. 1 to 7.

Furthermore, the control device 30 comprises spring devices 54, 55 which are designed, for example, as helical compression springs. Housing-mounted stops 56, 57 are in each case associated with the left-hand ends of the spring devices 54, 55 in FIGS. 1 to 7. The housing-mounted stops 56, 57 are provided on the pre-chamber cylinder 24.

The spring devices 54, 55 are clamped between the housing-mounted stops 56, 57 and the right-hand end 51 of the slider 50 having the control pressure surface 45. Thus, the slider 50 is supported on the housing-mounted stops 56, 57 by means of the spring devices 54, 55.

Figure 2:
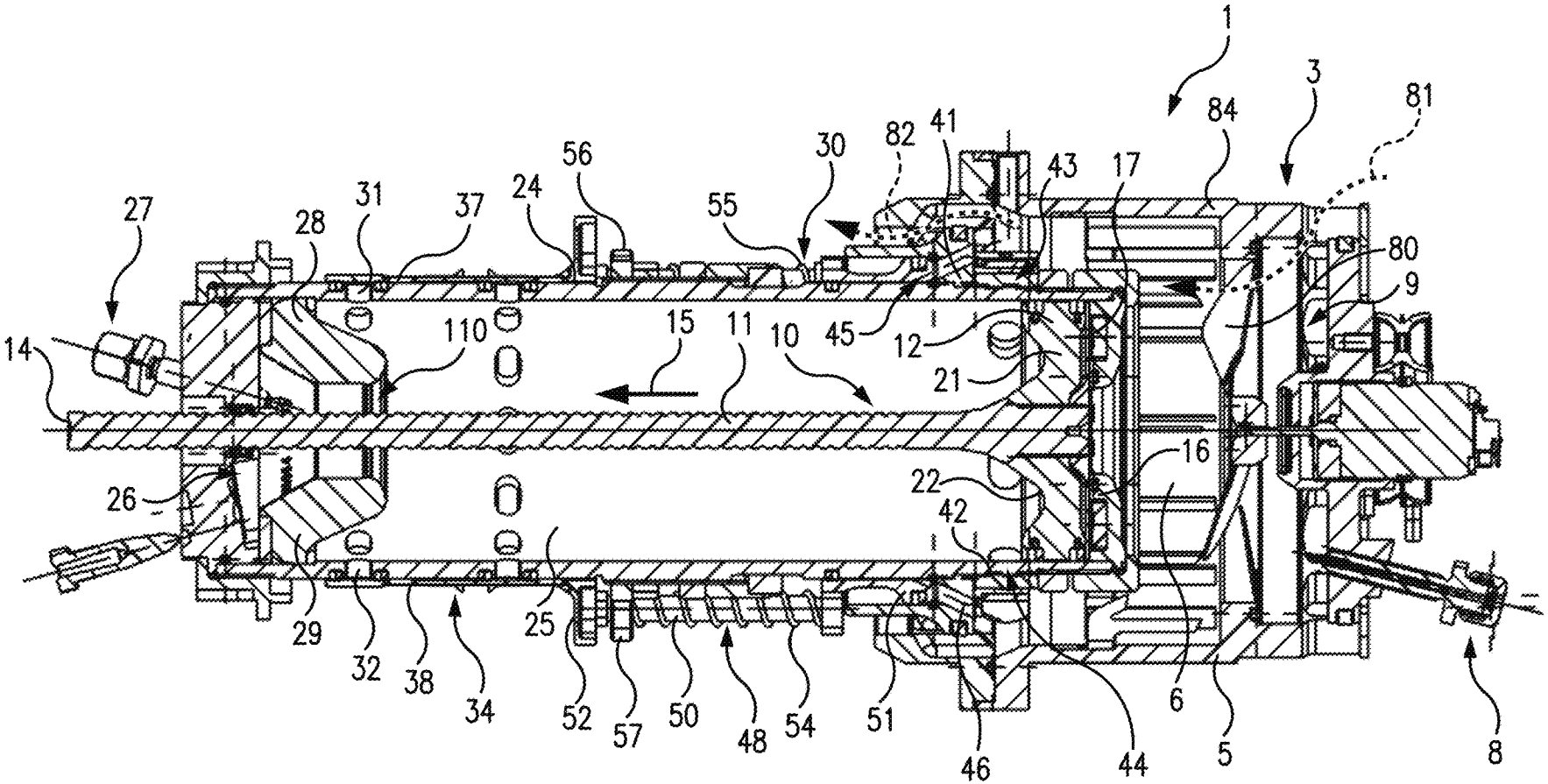
FIG. 2 shows a longitudinal section of the bolt firing device from FIG. 1.
Figure 3:
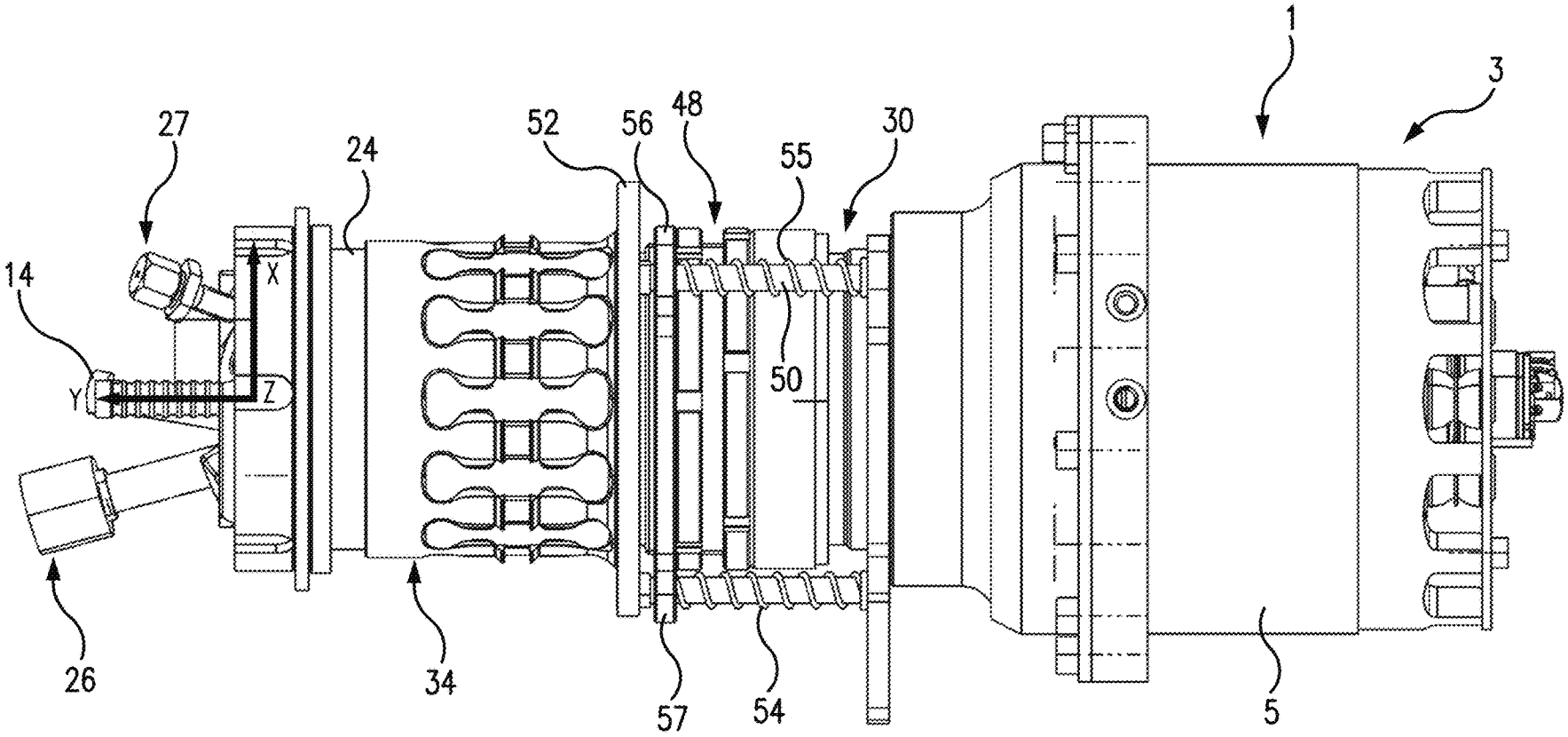
FIG. 3 shows a plan view of the bolt firing device from FIGS. 1 and 2 in a pressed state with a closed main combustion chamber.
Figure 4:
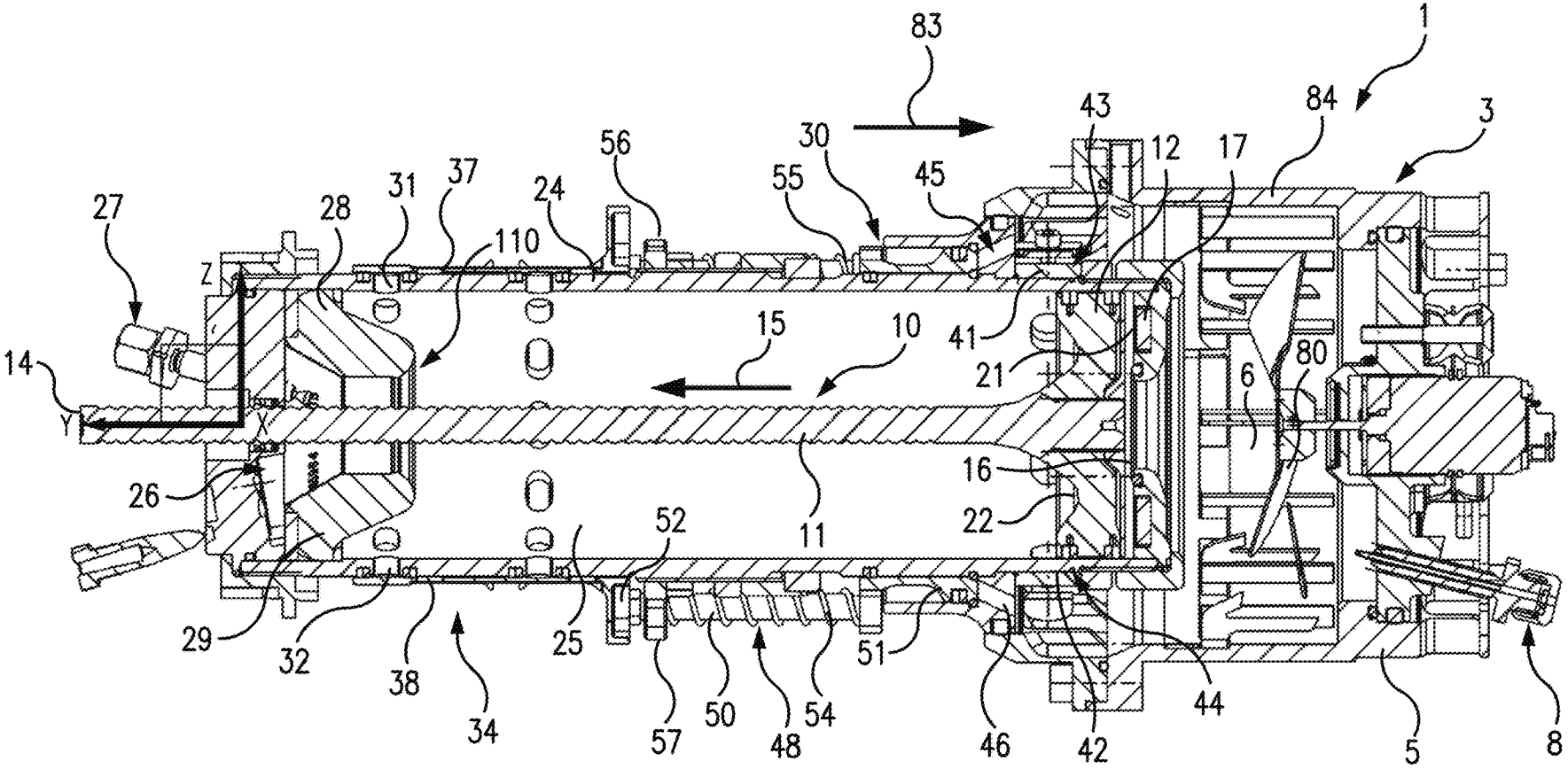
FIG. 4 shows a longitudinal section of the bolt firing device from FIG. 3.
Figure 5:
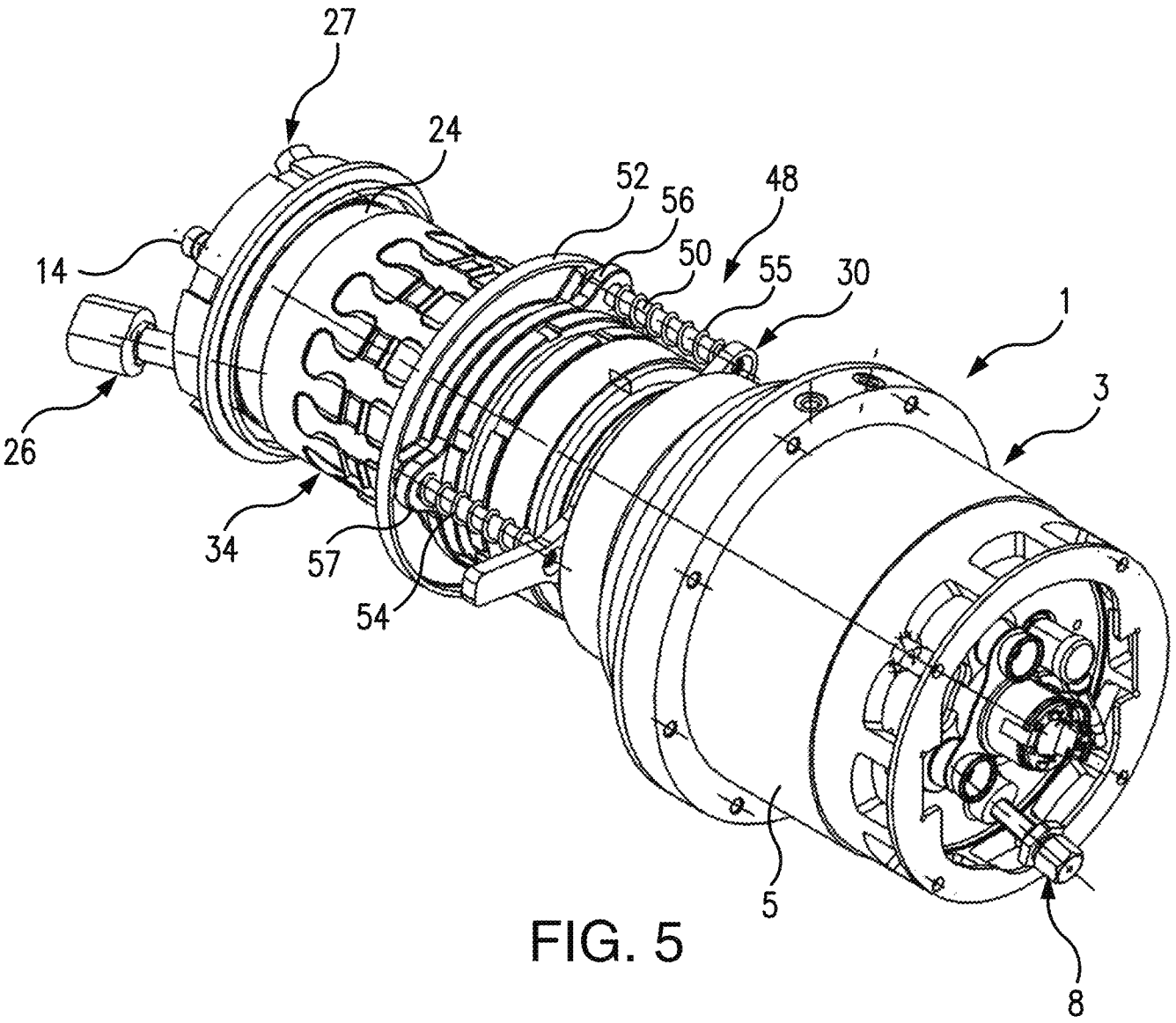
FIG. 5 shows a perspective representation of the bolt firing device from FIGS. 3 and 4.

In FIGS. 1 and 2 the bolt firing device 1 is shown in an unpressed state. "Unpressed state" means that the firing end 14 of the driving piston 10 is not acted upon by a pressing force. When pressed, the bolt firing device 1 is pressed with the firing end 14 against the substrate.

The main combustion chamber 6 is delimited by a combustion chamber sleeve 84 which can be moved to a limited extent in the axial direction in order to enable scavenging of the main combustion chamber 6. A fan 80 is arranged in the main combustion chamber 6.

In FIG. 2 the position of the combustion chamber sleeve 84 is such that the fan 80 generates an air stream 81, 82, indicated by arrows, from the rear face of the device, that is to say the right-hand face in FIG. 2, through the main combustion chamber 6 into the environment. After a firing operation exhaust gases are transported out of the main combustion chamber 6 by the air stream 81, 82. Furthermore, the air stream 81, 82 ensures cooling of the main combustion chamber 6.

In FIGS. 3 to 6 the bolt firing device 1 is shown in a pressed state. In the pressed state the tool tip of the bolt firing device 1 is pressed against a substrate. Due to the pressing movement the combustion chamber sleeve 84 is moved rearwards, that is to say towards the right in FIG. 4, as indicated by an arrow 83 in FIG. 4. The main combustion chamber 6 is closed off from the environment towards the rear by the movement 83 of the combustion chamber sleeve 84.

As described below, fuel gas is injected into the pre-chamber 25 by means of the inlet device 27 and into the main combustion chamber 6 by means of the inlet device 8. During injection of the fuel gas into the pre-chamber 25 and into the main combustion chamber 6 the fan 80 rotates in the main combustion chamber 6.

The ignition of the gas mixture is initiated by the ignition device 26 which is associated with the pre-chamber 25 and located in the vicinity of the buffer 110. After the ignition of the gas mixture in the pre-chamber 25, a flame front propagates, travelling from the side of the buffer 110 in the direction of the main combustion chamber 6, that is to say towards the right in FIG. 4. In this case the propagating flame front pushes uncombusted air/fuel mixture ahead of it at high pressure into the main combustion chamber 6.

The overflow from the pre-chamber 25 into the main combustion chamber 6 takes place by means of the overflow openings 41, 42 with the valve devices 43, 44 open. The valve devices 43, 44 are, for example, designed as non-return valves which expose the overflow openings 41, 42, which are also designated as ignition openings, during propagation of the laminar flame front.

When the flame front has reached the non-return valves of the valve devices 43, 44, the flame can pass via the non-return valves into the main combustion chamber 6 for ignition, so that the main chamber combustion is initiated in the main combustion chamber 6. In FIG. 6 is the main chamber ignition in the main combustion chamber 6 is indicated by a symbol 86.

During the main chamber ignition 86 the pressure in the main combustion chamber 6 rises and the control sleeve 34 is pushed forwards, that is to say towards the left in FIG. 6 as indicated by arrows 87, 88, against the force of the spring devices 54, 55 which are supported on the housing-mounted stops 56, 57. Two pressure relief connections 108, 109 of the pre-chamber 25 are opened by the movement 87, 88 of the control sleeve 34 forwards.

The pre-chamber pressure escaping from the pre-chamber 25 by means of the opened venting connections 108, 109 is indicated by arrows 91 to 94 in FIG. 6. The pressure relief connections 108, 109 are also designated as exhaust outlets. The pre-chamber pressure can escape by means of the pressure relief connections or exhaust outlets 108, 109 at the main chamber ignition 86. At the main chamber ignition 86 the driving piston 10 moves at high speed and carries out a firing.

In FIG. 7 the bolt firing device 1 is shown in longitudinal section during thermal return of the driving piston 10. After the driving piston 10 has reached the lower or front piston reversal point on the buffer 110, a main chamber residual pressure is discharged by means of the pressure relief connection 109. The consequence of this is that the main combustion chamber pressure in the main combustion chamber 6 drops to ambient pressure and the control sleeve 34 closes the exhaust outlets or pressure relief connections 108, 109 again in a pressure-controlled manner.

After the firing a negative pressure is produced in the main combustion chamber 6 by cooling of the bolt firing device 1. This negative pressure in the main combustion chamber 6 leads to the driving piston 10 being retracted or drawn back into its starting position. In this case fresh air is sucked or drawn into the pre-chamber 25 of the bolt firing device 1 through a pre-chamber inlet 140 on the left-hand end of the pre-chamber cylinder 24 in FIG. 7. The drawing in of the fresh air is indicated by an arrow 141 in FIG. 7.

A non-return valve on one side is advantageously associated with the pre-chamber inlet 140. The non-return valve comprises, for example, a relatively large spring lamella, which enables fresh air to be drawn into the pre-chamber 25, but in the reverse direction it prevents unwanted outflow of pressurized fuel/air mixture out of the pre-chamber 25 into the environment.

When the bolt firing device 1 with the firing end 14, which is shown truncated in FIG. 7, is lifted off from the substrate, the combustion chamber sleeve 84 is moved again so that the main combustion chamber 6 can be scavenged with ambient air, as indicated by the arrows 81 and 82 in FIG. 2. Subsequently a new firing cycle can be started.

The control device 30 is illustrated alone in different views in FIGS. 8 to 11. The control device 30 comprises the control sleeve 34 which is connected by means of the coupling element 48 to a coupling sleeve 100. The control pressure surface 45 designed as an annular surface 46 is provided on a free end of the coupling sleeve 100, that is to say the right-hand end of the coupling sleeve 100 FIG. 9.

The coupling 100 is fixedly connected to a connecting flange 105 by means of slider rods 101, 102, 103 which partially constitute the slider 50. The connecting flange 105 connects the control sleeve 34 to the slider rods 101 to 103. On the other hand, the slider rods 101 to 103 are connected by means of a connecting flange 98 to the coupling sleeve 100. A spring device 54, 55 designed as a compression spring is associated with each slider rod 101 to 103. In the installed state of the control device 30 the spring devices 54, 55 are clamped between the connecting flange 98 and the housing-mounted stops 56, 57 on the pre-chamber cylinder 24.

The control sleeve 34 serves to expose the through openings 31, 32; 117, 118 in the pre-chamber cylinder 24 as required, as indicated in FIG. 6 by the arrows 91 to 94. For this purpose the control sleeve 34 has the through openings 37, 38; 117, 118 which are made to overlap the through openings 31, 32; 111, 112 in the pre-chamber cylinder 24 for opening the venting connections 108, 109.

Figure 10:
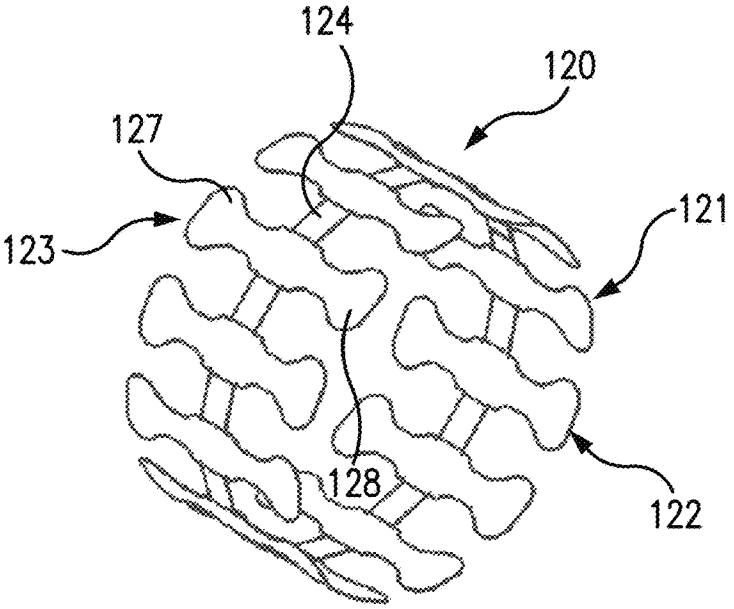
FIG. 10 shows a perspective representation of a non-return valve device which is integrated into the control device of FIGS. 8 and 9.

In FIG. 10 it can be seen that the non-return valve device 120 comprises valve elements 121 to 123 which are connected to one another by a connecting ring member 124. Each of the valve elements 121 to 123 comprises two closing elements 127, 128, which are associated with through openings 37; 118 of the two pressure relief connections 108; 109. The valve elements 121 to 123 with the closing elements 127, 128 are formed integrally from spring steel. The production of the valve elements 121 to 123 with the closing elements 127, 128 takes place, for example, by laser beam cutting. The connecting ring member 124 can likewise be produced by laser beam cutting from a spring steel material.

The invention claimed is:

1. A fuel-operated firing device for driving securing elements into a substrate, comprising at least one main combustion chamber for a fuel; a driving piston which can be driven out of the at least one main combustion chamber in a firing direction by expandable gases; and, a pre-chamber with which an ignition device is associated and in which a pressure acting on the at least one main combustion chamber can build up prior to a fuel/air mixture being ignited in said at least one main combustion chamber, wherein the pre-chamber has at least first and second venting connections spaced apart from one another in an axial direction and having through openings to enable rapid venting of the pre-chamber, wherein the at least first and second venting connections are provided with a non-return valve device.

2. The fuel-operated firing device according to claim 1, wherein the first venting connection in the axial direction is spaced further apart from the at least one main combustion chamber than the second venting connection.

3. The fuel-operated firing device according to claim 2, wherein the first venting connection is arranged in a vicinity of a stop and/or damping element for the driving piston.

4. The fuel-operated firing device according to claim 3, wherein each of the first and second venting connections comprise a series of through openings in a pre-chamber cylinder.

5. The fuel-operated firing device according to claim 4, the first and second venting connections comprise through openings in a control sleeve which, in an open position of the control sleeve, are made to overlap the through openings of the pre-chamber cylinder in order to expose the venting connections.

6. The fuel-operated firing device according to claim 5, wherein the control sleeve is combined with a non-return valve device for the first and second venting connections which opens if a positive pressure is present in the pre-chamber if the control sleeve is in the open position.

7. The fuel-operated firing device according to claim 6, wherein the non-return valve device comprises closing elements made of a spring steel material.

8. The fuel-operated firing device according to claim 2, wherein each of the first and second venting connections comprise a series of through openings in a pre-chamber cylinder.

9. The fuel-operated firing device according to claim 8, the first and second venting connections comprise through openings in a control sleeve which, in an open position of the control sleeve, are made to overlap the through openings of the pre-chamber cylinder in order to expose the venting connections.

10. The fuel-operated firing device according to claim 9, wherein the control sleeve is combined with a non-return valve device for the first and second venting connections which opens if a positive pressure is present in the pre-chamber if the control sleeve is in the open position.

11. The fuel-operated firing device according to claim 10, wherein the non-return valve device comprises closing elements made of a spring steel material.

12. The fuel-operated firing device according to claim 1, wherein each of the first and second venting connections comprise a series of through openings in a pre-chamber cylinder.

13. The fuel-operated firing device according to claim 12, the first and second venting connections comprise through openings in a control sleeve which, in an open position of the control sleeve, are made to overlap the through openings of the pre-chamber cylinder in order to expose the first and second venting connections.

14. The fuel-operated firing device according to claim 13, wherein the control sleeve is combined with the non-return valve device for the first and second venting connections which opens if a positive pressure is present in the pre-chamber if the control sleeve is in the open position.

15. The fuel-operated firing device according to claim 14, wherein the non-return valve device comprises closing elements made of a spring steel material.

16. The fuel-operated firing device according to claim 12, wherein a pre-chamber inlet is provided on an end of the pre-chamber cylinder remote from the at least one main combustion chamber.

17. The fuel-operated firing device according to claim 13, wherein a pre-chamber inlet is provided on an end of the pre-chamber cylinder remote from the at least one main combustion chamber.

18. The fuel-operated firing device according to claim 1, wherein the through openings of the first and second venting connections can be closed and exposed to enable rapid venting of the pre-chamber.

19. A method for operating a fuel-operated firing device according to claim 1, the method comprising venting the pre-chamber through the first and second venting connections.

20. A fuel-operated firing device for driving securing elements into a substrate, comprising at least one main combustion chamber for a fuel; a driving piston which can be driven out of the at least one main combustion chamber in a firing direction by expandable gases; and, a pre-chamber with which an ignition device is associated and in which a pressure acting on the at least one main combustion chamber can build up prior to a fuel/air mixture being ignited in said at least one main combustion chamber, wherein the pre-chamber has at least first and second venting connections spaced apart from one another in an axial direction and having through openings to enable rapid venting of the pre-chamber, wherein the driving piston travels over the second venting connection and discharges combustion gases from the at least one main combustion chamber through the second venting connection.

* * * * *